United States Patent [19]

Vaalburg et al.

[11] Patent Number: 4,749,423

[45] Date of Patent: Jun. 7, 1988

[54] METHOD OF MAKING A BONDED NONWOVEN WEB

[75] Inventors: Lawrence Vaalburg, Vineland; H. Paul Kaiser, Tuckerton, both of N.J.

[73] Assignee: Scott Paper Company, Philadelphia, Pa.

[21] Appl. No.: 863,230

[22] Filed: May 14, 1986

[51] Int. Cl.[4] ..... D04H 3/14

[52] U.S. Cl. ..... 156/181; 156/290; 156/309.6; 264/120; 264/126; 428/198; 428/296

[58] Field of Search ..... 156/181, 290, 309.6; 428/198, 296; 264/126, 119, 120

[56] References Cited

U.S. PATENT DOCUMENTS

| | | | |
|---|---|---|---|
| 3,772,107 | 11/1973 | Gentile et al. | 156/290 |
| 3,949,128 | 4/1976 | Ostermeier | 156/290 |
| 3,989,788 | 11/1976 | Estes, Jr. et al. | 264/120 |
| 4,195,112 | 3/1980 | Sheard et al. | 264/119 |
| 4,315,965 | 2/1982 | Mason et al. | 428/198 |
| 4,425,126 | 1/1984 | Butterworth et al. | 604/366 |
| 4,566,154 | 1/1986 | Streeper et al. | 19/296 |
| 4,576,852 | 3/1986 | Burgess et al. | 428/198 |
| 4,632,861 | 12/1986 | Vassilatos | 428/295 |

*Primary Examiner*—Jerome Massie
*Assistant Examiner*—David Herb
*Attorney, Agent, or Firm*—Joseph H. Yamaoka; John W. Kane, Jr.

[57] ABSTRACT

A method of making a nonwoven fibrous web. A web of primary fibers having uniformly distributed throughout secondary fibers containing 3 to 7 percent polyethylene by weight of the final web is formed on a conveying means. The polyethylene of the secondary fibers has a melting point that is lower than the melting point of the primary fibers. The web is then heated to a temperature below the melting point of the primary fibers but above the melting point of the polyethylene of the secondary fibers thereby causing some of the polyethylene fibers to bond to each other or to the primary fibers. The web is then heated to a temperature above the melting point of the primary fibers to form primary fiber-to-primary fiber thermal bonds which provide substantially all of the useful strength of the web.

8 Claims, 2 Drawing Sheets

METHOD OF MAKING A BONDED NONWOVEN WEB

TECHNICAL FIELD

This invention relates to a method for forming a nonwoven fibrous web, and more particularly to a method for stabilizing the web prior to the thermal bonding of the web.

BACKGROUND ART

The use of carding machines for forming nonwoven webs of staple-length fibers, oriented in the machine direction of web formation, are well known in the prior art. Such a machine and method of forming a web is disclosed in U.S. Pat. No. 3,772,107—Gentile, et al. As disclosed in Gentile, et al. as well as in U.S. Pat. No. 4,566,154—Streeper, et al. it is common to use a web spreading apparatus to increase the cross machine width of the web coming out of the card line by as much as 45 percent. In the older carding machines, the fibers in the formed web were very highly oriented in the machine direction of web formation. Randomizing rolls have been developed which greatly reduce the tendency of the fibers in the formed web to be oriented in the machine direction of web formation. A problem that has been encountered in using the randomizing rolls to reduce the machine direction orientation of the fibers in the web is that it becomes more difficult to remove the formed web from the forming surface for further processing.

U.S. Pat. No. 4,425,126—Butterworth, et al. discloses a process for making a fibrous web in which 10 percent or more by weight of the fibers are synthetic wood pulp fibers formed of polyethylene. The web is then heated to a temperature above the melting point of the synthetic wood pulp fibers but below the melting point of the other fibers in the web thereby causing the synthetic wood pulp fibers to be fused and bonded with each other and with at least some of the other fibers in the web. The stabilized web of Butterworth, et al. is then subjected to a second bonding step with adhesive (latex). As stated at column 3, lines 42–47, the bonds formed by the fused synthetic wood pulp fibers greatly reduces, if not eliminates the wet collapse of the web when the aqueous latex solution is applied to the web during the adhesive bonding step.

U.S. Pat. No. 3,989,788—Estes, et al. also discloses a process in which a web undergoes a first stabilizing bonding step followed by a second bonding step. During the first bonding or consolidation step, the web is heated so that the binder filaments become tacky generating some binder-to-binder bonds and binder-to-matrix bonds. The matrix filaments are not appreciably affected by the consolidation step. The web is then subjected to a second bonding step at a higher temperature, that will melt the binder fibers so that they lose their filamentary form and act as an adhesive, but which has only a slight softening on the matrix fibers.

Applicant has found that in trying to apply the technology of Butterworth, et al. and Estes, et al. to the web forming process as disclosed in U.S. Pat. No. 4,315,965—Mason, et al. by adding polyethylene binder fibers on the order of 10 percent or more by weight of the finished web to polypropylene fibers, the strength of the thermally bonded web is decreased significantly.

Furthermore, it is not obvious that one could stabilize the web by using bonding fibers and still be able to spread the stabilized web.

It is, therefore, one object of this invention to provide a method of stabilizing an unbonded web by using secondary bonding fibers and then thermally bonding the stabilized web, in which all of the strength of the thermally bonded web is due to the fiber-to-fiber bonding of the primary fibers.

It is another object of this invention to stabilize an unbonded web in a manner that does not otherwise materially reduce the strength of the thermally bonded web.

And yet another object of this invention is to provide a method of stabilizing an unbonded web by using secondary bonding fibers and then spreading the stabilized web.

DISCLOSURE OF THE INVENTION

In accordance with this invention, there is provided a method of making a nonwoven fibrous web in which there is formed on a conveying means a web of primary fibers having uniformly distributed throughout up to 7–8 percent by weight of secondary fibers, the secondary fibers having a melting point that is lower than the melting point of the primary fibers. The web is then heated to a temperature below the melting point of the primary fibers but above the melting point of the secondary fibers thereby causing some of the secondary fibers to bond to each other or to the primary fibers. The web is then heated to a temperature above the melting point of the primary fibers to form primary fiber-to-primary fiber thermal bonds which provide substantially all of the useful strength of the web.

In another aspect of this invention, after the web is pre-bonded by heating the secondary fibers, the web is spread in the cross direction by at least 45–50 percent.

In yet another aspect of this invention, the primary fiber-to-primary fiber thermal bonds are obtained by subjecting discrete areas of the web to pressure and heating the fibers in those compressed areas to a temperature above the melting point of the primary fibers.

This method has been found to be particularly useful when the primary bonding fibers are polypropylene fibers and when the secondary fibers are either polyethylene fibers or bicomponent fibers having a polyethylene sheath.

BEST MODE FOR CARRYING OUT THE INVENTION

Figure 1:
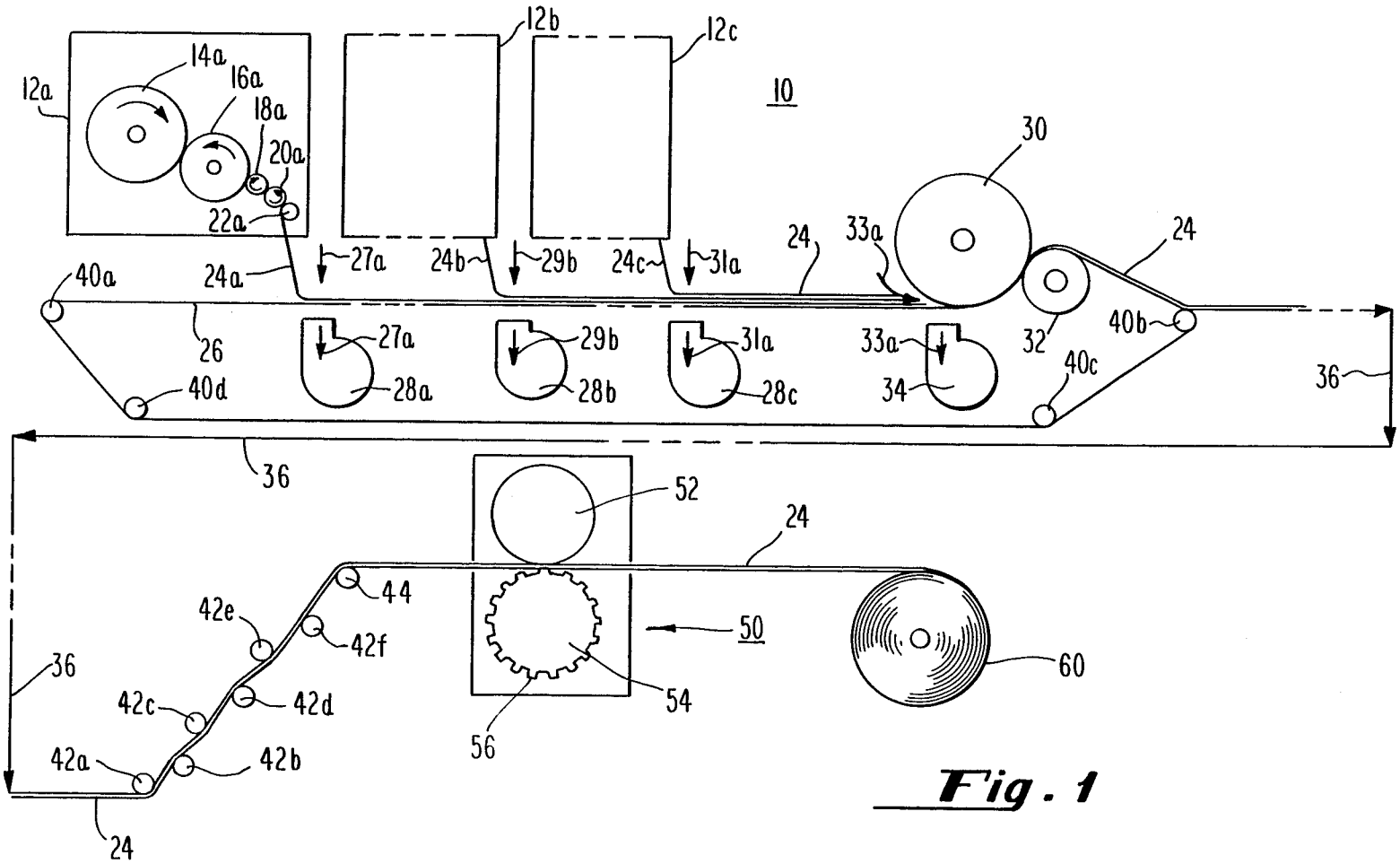
FIG. 1 is a schematic block diagram of apparatus for carrying out the method of this invention; an FIG. 2 is a graph showing final web tensile strength versus percent polyethylene secondary bonding fibers.

FIG. 1 is a schematic representation of a machine 10 that manufactures a nonwoven fibrous web using the method of this invention. The machine 10 includes conventional lap or layer forming means, such as carding sections **12*a*, 12*b*, 12*c* for forming laps 24*a*, 24*b*, 24*c* of loosely associated staple fibers. Each carding section 12*a*, 12*b*, 12*c* includes a main cylinder 14*a*, 14*b*, 14*c* having a plurality of pins or wire points (not shown) disposed about the periphery thereof for combing fibers from a feed mat of staple fibers to orient the major proportion of said fibers substantially in the machine direction. In addition, each carding section 12*a*, 12*b*, 12*c*** includes a doffing roll 16a, 16b, 16c for collecting and removing the oriented fibers from the main cylinder 14a, 14b, 14c. In one embodiment, a lap removing means 22a, 22b, 22c such as that sold under the trademark "Doffmaster" by John D. Hollingsworth on Wheels, Inc. of Greenville, SC is disposed adjacent to the doffing roll 16a, 16b, 16c of each carding section 12a, 12b, 12c for removing the laps 24a, 24b, 24c from the doffing roll 16a, 16b, 16c and for directing said laps 24a, 24b, 24c into overlying relationship onto an upper horizontal delivery run of a porous continuous conveyor belt 26. In the preferred embodiment, the fibrous laps on the doffing rolls 16a, 16b, 16c are fed through a pair of randomizer rolls 18a and 20a, 18b and 20b, and 18c and 20c which tend to reorient the fibers so that they will ultimately be placed on the conveyor belt 26 in more random directions by the lap removing means 22a, 22b, 22c. Randomizer rolls are also manufactured by John D. Hollingsworth.

In one embodiment, each lap 24a, 24b, 24c has as its primary content up to about 97 percent staple length fabric fibers and uniformly mixed throughout anywhere between 3 to 7 or 8 percent by weight of staple length secondary bonding fibers, the secondary fibers having a lower melting point than the primary fabric fibers. It will be realized by those skilled in the art that it is not necessary for each lap 24a, 24b, 24c to have the secondary bonding fibers. In fact, in our most preferred embodiment, all of the secondary, bonding fibers are uniformly distributed throughout the center fibrous lap 24b. In the most preferred embodiment, the primary fabric fibers are polypropylene fibers such as Types T-181 and T-182 made by Hercules and the secondary bonding fibers are polyethylene fibers such as Type PE11 or PE14 made by B.A.S.F., formerly Enka Fibers or bicomponent fibers having a polypropylene core and a polyethylene sheath such as ES-L type made by Jacob Holm, Inc. Other primary fibers that can be used are polyester and rayon. Another bonding fiber that can be used is sold by Celanese under the trade name Vinyon. It should be pointed out that when the secondary fiber is a bicomponent fiber such as the ES-L type, the amount of bicomponent fibers is such that the formed web 24 approaching the heated consolidation roll 30 contains up to 7 or 8 percent by weight of polyethylene.

Figure 2:
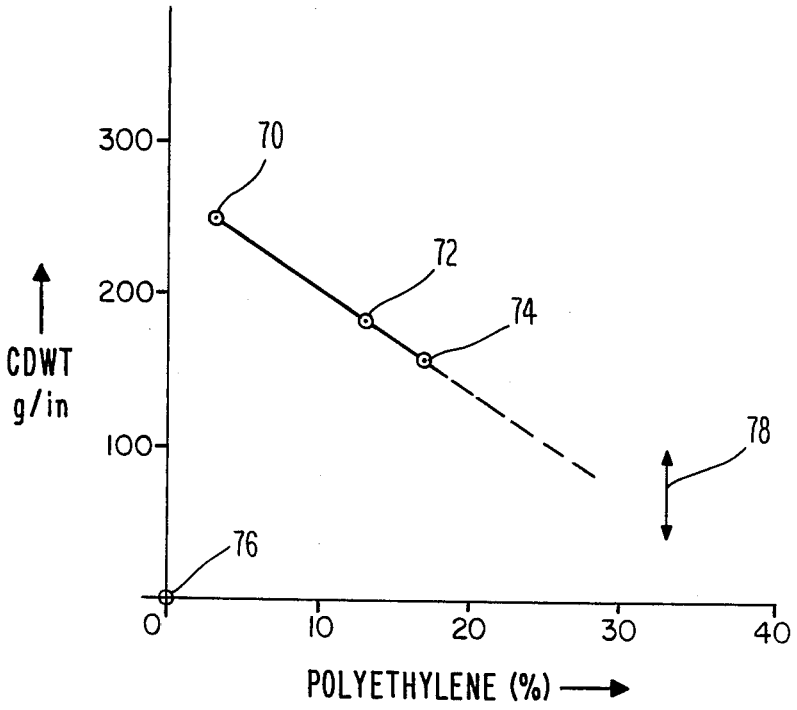

FIG. 2 shows the tensile strength of final webs made in a process similar to that of the present invention. The nominal basis weight of the webs was 10 pounds per 2880 square feet (17 grams per square meter). The amount of polyethylene bonding fibers was varied between 3 percent and 33 percent, the balance of the webs being polypropylene fibers Type T-181. The web making process provided for partial randomization and included first and second thermal bonding steps in accordance with this invention. FIG. 2 shows that with as little as 3 percent polyethylene binder fibers, the web is stable enough to be removed from the conveyor belt 26. It is believed that the amount of secondary bonding fibers cannot be reduced much lower than 3 percent because then there would be insufficient fibers to stabilize the web. As illustrated by the point 76, it is also known that with no polyethylene in the web it is not possible to remove the formed web 24 from conveyor 26. FIG. 2 also shows that with about 10 percent polyethylene, the web has about 20 percent less tensile than the web with 3 percent polyethylene and at 33 percent polyethylene, the web has a tensile less than 100 grams per inch as indicated by the line 78. The 20 percent reduction in tensile is not acceptable for many commercial web materials. The tensile measurements shown in the graph of FIG. 2 were measured in accordance with ASTM standard D-1682 with a jaw span of 5 inches and a jaw speed of 5 inches per minute.

As shown in FIG. 1, the first fibrous lap 24a is deposited on the surface of the forming conveyor belt 26 which is porous. The porous conveyor 26 travels in a closed loop as determined by guide roll 40a, consolidation roll 30, guide or press roll 32, and guide rolls 40b, 40c, 40d. In one embodiment, the conveyor belt 26 is made out of polyurethane and is identified as TU-16 manufactured by Habasit Company and has a uniform pattern of one-eighth inch round holes spaced on three-eighths centers. The fibrous lap 24a is deposited onto the upper surface of the conveyor belt 26 and in a preferred embodiment, air suction means 28a located beneath the forming conveyor belt 26 pulls air as indicated by arrows 27a from above the conveyor belt 26 through the fibrous lap 24a and through the conveyor belt 26 to assist in depositing the fibrous lap 24a onto the upper surface of the porous conveyor belt 26. In a similar manner, air suction means 28b assists in depositing fibrous lap 24b onto fibrous lap 24a and air suction means 28c assists in depositing fibrous lap 24c onto fibrous lap 24b thereby completing the formed fibrous web 24. The path of the porous forming conveyor belt 26 is such as to partially wrap a heated consolidation roll 30. In one preferred embodiment, the roll 30 is a patterned roll having a uniform distribution of raised rectangular areas covering 6 to 7 percent of the surface area of the roll 30. Each rectangular area is approximately 0.125 inches by 0.026 inches and is covered with teflon. As the formed fibrous web 24 travels between the heated consolidation roll 30 and the porous conveyor belt 26, the web 24 is heated to a temperature above the melting temperature of the secondary bonding fibers but below the melting temperature of the primary fabric fibers thereby causing many of them to bond to each other and to the primary fabric fibers to stabilize the web. In order to assure that air entrained in the formed fibrous web 24 is orderly removed, it is desirable to have a vacuum means 34 located beneath the forming conveyor belt 26 and located in the vicinity of where the forming conveyor belt 26 approaches the outer periphery of the heated consolidation roll 30. This vacuum means 34 pulls air as indicated by arrow 33a entrapped within the fibrous web 24 through the web 24 and the porous belt 26 thereby providing orderly removal of the air entrained within the fibrous web 24.

As shown in FIG. 1, the roll 32 is shown to be in a nip relationship with the consolidation roll 30, however this is not essential and roll 32 could be merely another guide roll that is not in nip relationship with the heated consolidated roll 30. When the web is conveyed out of contact with the heated consolidation roll 30, it will be stabilized to the extent that it can be removed from the forming conveyor belt 26 and, as indicated by the arrows 36, conveyed at least over a short unsupported distance to the next stage of the machine.

In one preferred embodiment, the next stage of the machine is a spreading apparatus 42 which increases the cross machine width of the web from anywhere between 45 percent and 50 percent. Other spreaders can be used which spread the web from anywhere between 10 percent and 70 percent. These spreader rolls 42a–42f are well known in the art and, for example, can have the shape as disclosed in U.S. Pat. No. 4,566,154—Streeper, et al. Although the bonds formed by the melting of the secondary bonding fibers at the heated consolidation roll 30 form strong enough bonds to allow the unsupported web 24 to be transferred to the spreader 42, some of the bonds are broken as the web travels through the spreader rolls 42*a*–42*f* thereby allowing the width of the web to be increased. Some of the bonds formed by the melting of the secondary bonding fibers are not broken in the spreader section 42 thereby preserving the random orientation of many of the fibers in the formed web 24. As the spread web 24 leaves the spreader section 42 it passes over a straight guide roll 44 and, as disclosed in U.S. Pat. No. 4,315,965—Mason, et al., the web 24 then undergoes a bonding step at bonding apparatus 50 which in the most preferred embodiment consists of a backup roll 52 and a heated embossing roll 54 wherein the fibers in the web 24 are heated and compressed in the nip formed by the raised land areas 56 of embossing roll 54 so that the primary fabric fibers are melted to form melt bonds extending at least through the web from the surface of web 24 in contact with the embossing roll 54. The backup roll 52 is a solid roll, for example one made out of steel. Virtually the entire strength of the final web 24 when it comes out of the bonding apparatus 50 is provided by the fiber-to-fiber bonding of the primary fibers, the secondary fibers (polyethylene) contributing virtually no strength to the finished web 24. After the thermally bonded web leaves the bonding station 50, it is wound into a parent roll 60.

What we claim as new and desire to be secured by Letters Patent of the United States is:

1. A method of making a nonwoven fibrous web comprising the steps of:

(a) forming on a conveying means a web of primary fibers having uniformly distributed throughout secondary fibers containing 3 to 7 percent polyethylene by weight of the final web, the polyethylene having a melting point that is lower than the melting point of the primary fibers;

(b) heating the web to a temperature below the melting point of the primary fibers but above the melting point of the polyethylene to cause some of the polyethylene to bond to each other or to the primary fibers thereby giving the web minimal strength to withstand unsupported transfer to a next process step; then (c) subjecting discrete areas of the web to pressure and heating the fibers in those discrete areas to a temperature above the melting point of the primary fibers to form primary fiber-to-primary fiber thermal bonds, the primary fiber-to-primary fiber thermal bonds providing substantially all of the useful strength of the final web.

2. The method as recited in claim 1 wherein the forming step comprises the steps of:

(a) forming two or more layers of primary fibers, at least one of the layers having a minor percent by weight of secondary fibers uniformly distributed therein, so that the finished web contains up to 7 percent by weight of secondary fibers;

(b) subjecting two or more of the layers to randomizing means for reorienting the fibers; and (c) depositing the layers on a conveyor means.

3. The method as recited in claim 1 wherein after the first heating step and before the bonding step:

(a) the web is transferred from the conveying means to a spreading means; and (b) spreading the web in the cross direction from about 10 percent to over 60 percent.

4. The method as recited in claim 1 wherein the secondary fibers are bicomponent fibers having a polyethylene sheath in an amountt such that the formed web contains up to 7 percent by weight of polyethylene.

5. The method as recited in claim 1 wherein the formed web comprises between 93 to 97 percent polypropylene fiber and 3 to 7 percent polyethylene fiber.

6. The method as recited in claim 2 wherein after the first heating step and before the bonding step:

(a) the web is transferred from the conveying means to a spreading means; and (b) spreading the web in the cross direction from about 10 percent to over 60 percent.

7. The method as recited in claim 6 wherein the secondary fibers are bicomponent fibers having a polyethylene sheath in an amount such that the formed web contains up to 7 percent by weight of polyethylene.

8. The method as recited in claim 6 wherein the formed web comprises between 93 ot 97 percent polypropylene fiber and 3 to 7 percent polyethylene fiber.

* * * * *